US006145598A

United States Patent [19]

Carisella

[11] Patent Number: 6,145,598

[45] Date of Patent: Nov. 14, 2000

[54] HYDROSTATIC, SLOW ACTUATING SUBTERRANEAN WELL TOOL MANIPULATION DEVICE AND METHOD

[76] Inventor: James V. Carisella, P.O. Box 10498, New Orleans, La. 70181-0498

[21] Appl. No.: 08/971,853

[22] Filed: Nov. 17, 1997

[51] Int. Cl.[7] ..... E21B 33/127

[52] U.S. Cl. ..... 166/387; 166/382; 166/122; 166/187

[58] Field of Search ..... 166/382, 122, 166/387, 373, 120, 381, 319, 66.7, 187, 321; 175/40, 269, 67; 137/68.13; 251/62, 63; 277/333

[56] References Cited

U.S. PATENT DOCUMENTS

| | | | |
|---|---|---|---|
| 4,823,881 | 4/1989 | Streich | 166/382 |
| 5,033,549 | 7/1991 | Champeaux et al. | 166/278 |
| 5,058,673 | 10/1991 | Muller et al. | 166/187 |
| 5,203,414 | 4/1993 | Hromas et al. | 166/382 |
| 5,411,096 | 5/1995 | Akkerman | 166/321 |

*Primary Examiner*—William Neuder
*Attorney, Agent, or Firm*—Beirne Maynard & Parsons, L.L.P.

[57] ABSTRACT

A pressure balanced, slow actuating device and method for manipulation of an auxiliary tool within a subterranean well in which the hydrostatic pressure within well fluids in the well are utilized to meter and extend the timing of actuation of a component or auxiliary tool within a subterranean well.

12 Claims, 6 Drawing Sheets

HYDROSTATIC, SLOW ACTUATING SUBTERRANEAN WELL TOOL MANIPULATION DEVICE AND METHOD

BACKGROUND OF THE INVENTION (1) Field of the Invention

The invention relates to a pressure balanced, slow actuating device for manipulation of an auxiliary tool, such as a mechanically set packer, tubing or casing hangar, or an inflatable packer or bridge plug, or the like.

(2) Brief Description of the Prior Art

It has become apparent in recent years that in order to improve the success rate in the sealing of packers, bridge plugs and the like, it is advantageous to have a slow setting cycle, resulting in a comparatively slow, continuous stroke upon the actuating mechanism from the beginning of the setting cycle until its completion. Many subterranean well packers and bridge plugs contain anti-extrusion elements which are inelastic, i.e., the performance or characteristics depend upon the rate at which deformation occurs, as well as the rate of load application. Such components effective operation is very time dependent and it is desirable to deform them slowly to control physical properties during deformation. In the past, a lengthened time cycle for the activation of subterranean well auxiliary tools, such as packers, bridge plugs, tubing and casing hangers, safety valves, fishing tools, and the like, as well as manipulation of pressure setting mechanisms utilized to initiate the manipulation of such auxiliary tools (all hereinafter referred to as "auxiliary tool") has been achieved by the utilization of a slow burning power charge to build up pressure comparatively slowly within a chamber, resulting in the time of the setting or actuating cycle being approximately equivalent to the burn time of the power charge. The power charge would be ignited by conventional means, such as electric line igniting elements, well known to those skilled in the art, to fire the power charge resulting in the fracturing of slips, if used in conjunction with a mechanically set packer, bridge plug or the like, to initiate the stroking mechanism and resulting sequential steps. The power charge results in an increase in internal pressure within a chamber to sever or shear a tension bolt to initiate the sequential setting mechanisms. The auxiliary tool, such as a packer, will entrap energy resulting from the compression of the elastomer which, in turn, applies a hydrostatic pushing stress against the internal diameter of the conduit or wall upon which the tool is to be set, resulting in a hydraulic seal.

The characteristics and resisting forces of packing elements and the accompanying anti-extrusion elements are significantly different when deformation occurs over a comparatively extended period of time when compared to those characteristics when the setting procedure occurs over only a few seconds time interval due to the inelastic nature of the utilized elastomer. A rapid deformation will result in fluid being trapped between the elastomer and the casing or between the elastomeric packing element and the anti-extrusion element. After setting, the trapped fluid may escape, resulting in a loss of energy required for proper setting. The elastomeric elements have a tendency to fill the area where the previously trapped fluid was contained. Accordingly, when such elastomeric materials flow into these void spaces, the state of compressive stresses resulting from the application of hydrostatic pressure within these fluids is relaxed, resulting in a serious loss of setting integrity through the auxiliary tool, such as the packer. In more serious instances, the tool, such as the packer, not only will become unsealed, but will become unset and may fall downwardly in the well, resulting in a costly and time-consuming fishing trip or, even worse, the total loss of the well.

The use in the past of slow burning power charges which increase the setting cycle from a few seconds to one or more minutes has been utilized to abate these very serious problems. Such power charges are commercially available and well known to the industry. Typical of such devices is the Model "E-4" Wireline Pressure Setting Assembly, Product No. 437-02 of Baker International Corporation. The power charge in this setting tool is actuated by means of an electric line which ignites the power charge, causing stroking of a piston which is extended to a setting mandrel, or the like, to the auxiliary tool. The pressure setting assembly is secured at its lower end to the upper most end of the auxiliary tool to be set or actuated within the subterranean well.

While the use of slow burning power charges is intended to assure the satisfactory setting of tools, as described above, such mechanisms solve one problem, but create others. For example, the temperature at setting depth of a typical auxiliary tool in most subterranean wells throughout the world is approximately 150° F. and in such cases the burn/setting cycle is typically within a satisfactory time frame of from between about 30 to about 45 seconds. However, in stark contrast, as the temperature of the well increases, the burn/setting cycle time is decreased substantially, such that it may be reduced to about 20 seconds in temperature environments of about 300° F. and may be reduced to from between about 200 milliseconds to about 2 seconds when temperatures of about 400° F. are encountered, thus almost totally defeating the purpose of the utilization of such power charges for long cycling setting operations. Moreover, at such higher temperatures, some power charges may even explode, as opposed to burn, giving off contaminating gas as the result ol the relatively low order of ignition. An explosion, as opposed to a deflagration, thus occurs.

An additional problem encountered frequently in the use of power charge mechanisms for the setting of auxiliary tools in subterranean wells is the requirement for radio silence prior to, during and subsequent to the setting operation in order to avoid and inadvertent or premature activation of the power charge. Oftentimes, many hours are required to run the setting assembly on electric line with the auxiliary tool to the proper setting depth in the subterranean well, and an equal amount of time is required to retrieve the electric line. Safety requirements mandate complete elimination of all radio communications during such operations. Finally, disassembly of such setting assemblies incorporating power charges subsequent to the setting operation can be extremely dangerous to operating personnel as a result of trapped pressure within the device.

The present invention remedies many of the problems associated with conventional and prior art power charge pressure setting devices by providing a device which does not require the use of explosives. The device of the present invention can provide extended period setting cycle times regardless of the temperature environment at the setting or manipulation depth for the auxiliary tool in the subterranean well. Furthermore, there is no trapped pressure within the device when it is returned to the surface of the well.

The device of the present invention will provide an exceptionally long stroke capability, as well as volume capability, which may be adjusted to accommodate the particular size and operation of the auxiliary and other tools.

The device does not yield toxic waste products which are commonly associated with conventional power charges. The device is capable of running and setting conventional packers as well as inflatable packers with a battery operated slickline power or other supply. It may be deployed on electric or wire line and is selectively initiated. Since it is not dependent upon power charges, radio silence is not required during running in, actuation, or retrieval of the device in the well.

SUMMARY OF THE INVENTION

Figure 1A:
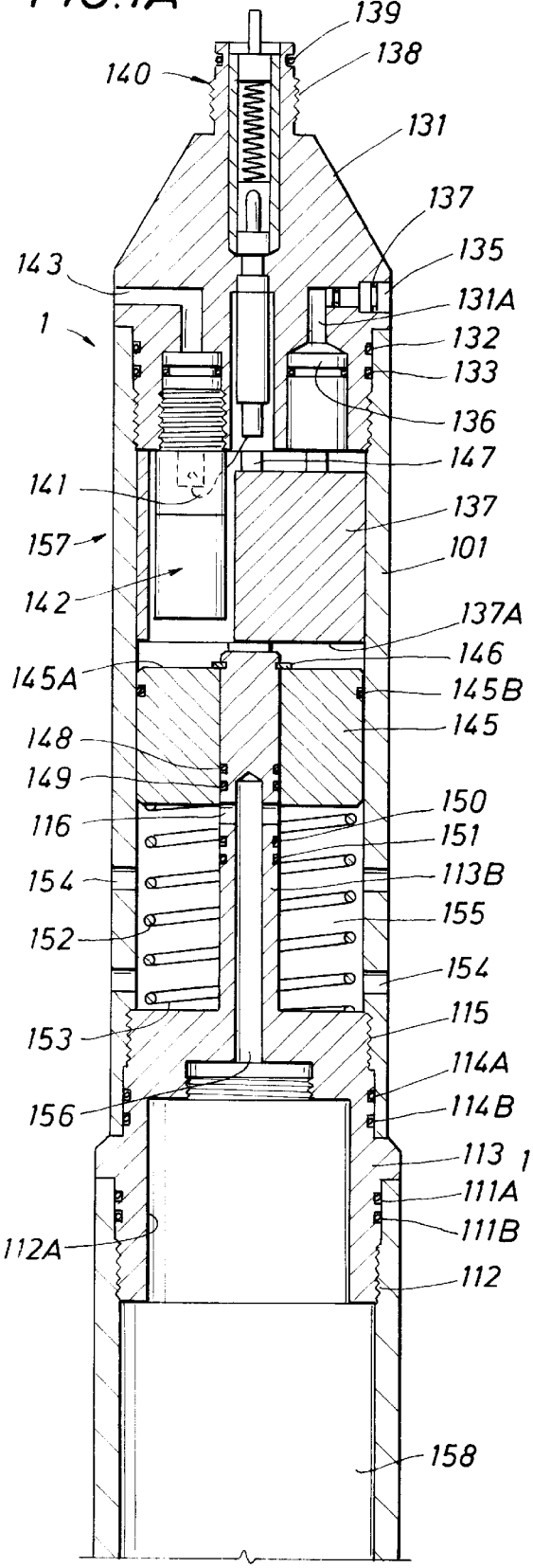
FIGS. 1A–1D together constitute an elongated longitudinal cross-sectional view of the device of the present invention prior to introduction of control fluid and, further, illustrating the first piston and associated stroking rod positioned to maximize the area in the primary stroking chamber.
Figure 1B:
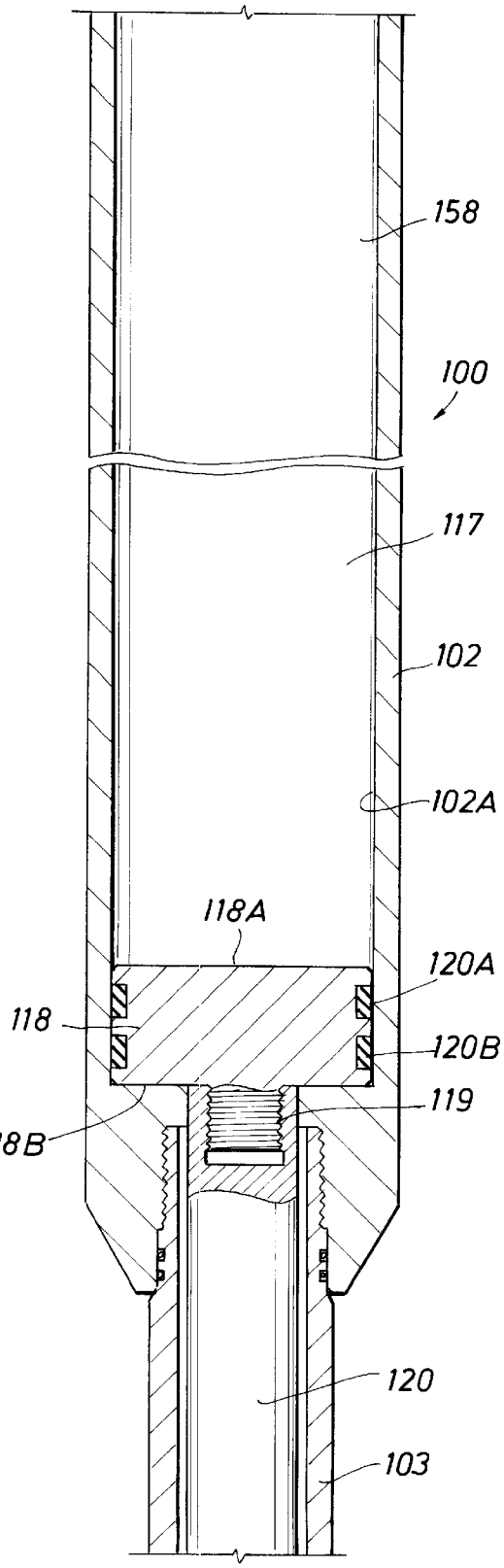
Figure 1C:
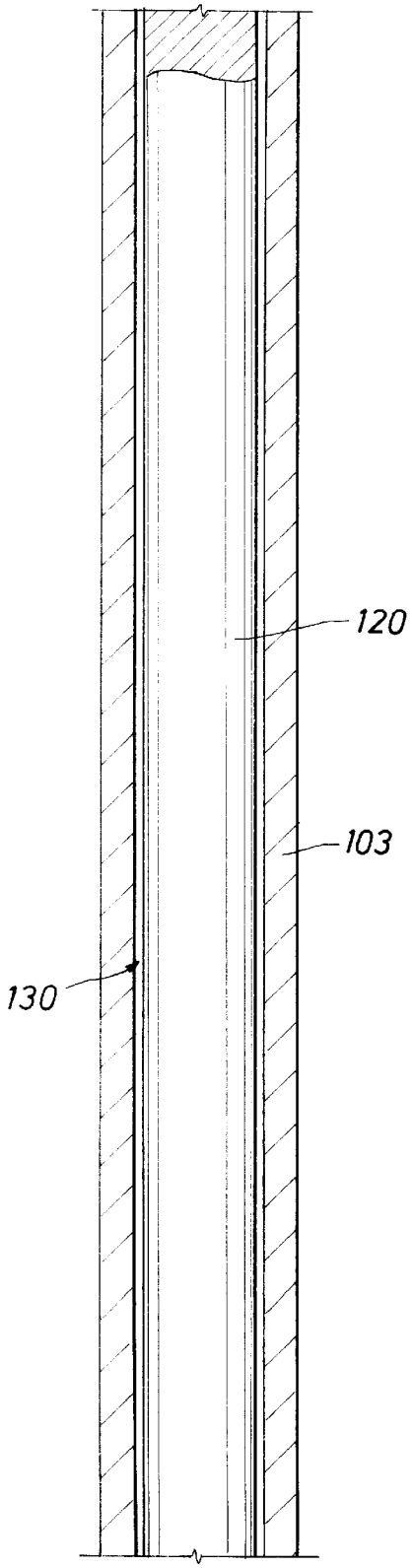
Figure 1D:
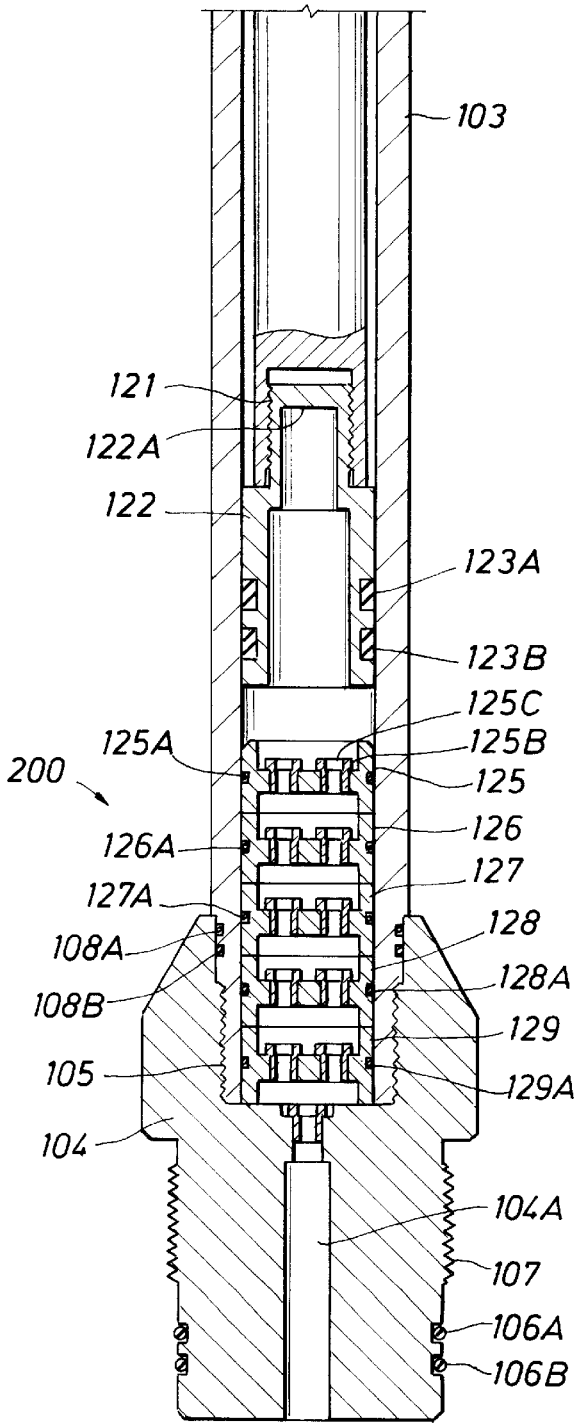

The present invention provides a pressure balanced, slow actuating device for manipulation of an auxiliary tool, such as an inflatable packer, or the like, within a subterranean well. Additionally, the device of the present invention may also be utilized in other, but similar, operations within a subterranean well, where a comparatively long cycling of high pressure fluid is required. For example, the device of the present invention may be utilized with a tool which transmits the incompressible stroking fluid through the metering means through a series of circumferentially subscribed injection nozzles on a nozzle spray assembly connected to the device of the present invention to wash or clean out perforations in the subterranean well.

The incompressible fluid typically will be clean or purified water, or may be a cementious fluid which may be injected through the device and an auxiliary tool to within an interior area of an inflatable element of an inflatable packer or the like to set the packer and, upon hardening or curing of the cementious fluid, provide auxiliary or backup setting or sealing component for the inflatable device. The device of the present invention may be provided in the form in which the setting or other mechanism in the auxiliary tool is "pushed" for manipulation or activation of the auxiliary tool or, alternatively, the device of the present invention may be designed where such actuating mechanism is "pulled" to initiate the setting or other manipulation of the auxiliary tool within the well.

The device contemplates an elongated cylindrical housing with a piston assembly being defined within the housing and including a piston head with a differential pressure area there across for application of hydrostatic pressure within well fluids to the piston assembly. Valving means are provided for selectively controlling the application of the hydrostatic well pressure of the well fluids upon the piston assembly. In one embodiment, a chamber is defined within the housing for receipt of a substantially incompressible flowable activating fluid, described above, and includes an area for accommodation of thermal expansion of the activating fluid resulting from movement of the device to a high pressure setting area within the subterranean well. Metering means are provided for controlling the rate of flow of a fluid body through the device and within or to the auxiliary tool. Preferably, the metering means will be a series of stacked orifice plates permitting the substantially incompressible fluid to be slowly but positively transmitted through a series of orifices, one after another, to delay the flow of the fluid body, thus enhancing the time and effectiveness of the setting or manipulation stroke for the auxiliary tool.

A secondary piston head may be disposed within the chamber in one embodiment and includes a second differential pressure area thereacross which is responsive to fluid pressure within the chamber and the auxiliary tool. The differential pressure area of the first piston head is substantially greater than the differential pressure area of the secondary piston head to intensify its effect upon the substantially incompressible fluid within the stroking chamber and thus the effectiveness of the device. An elongated stroking rod is operatively disposed between the first and secondary piston heads and within the housing.

The valving means preferably comprises first, second and third chamber members with the first chamber member receiving a body of injected control fluid, such as conventional hydraulic fluid. A flow passageway extends between the second and third chamber members and means are provided for communication of well fluid into the third chamber at all times. A valve head member is disposed between the first, second and third chamber members and is sealingly selectively positionable across the passageway to prevent fluid flow from the third chamber member into the second chamber member. Means, such as a solenoid actuated one-way check valve, are provided for discharging the control fluid out of the first chamber means and which may be activated by a number of known means, such as by electric signal through electric line carrying or otherwise associated with the device. Finally, the valving means comprises means for biasing the valve head member, such as a compressible spring, in one direction to open the flow passageway between the second and third chamber members upon the discharge of the control fluid from within the first chamber member as a result of electric or other actuation of the solenoid or other valving member to discharge the hydraulic control fluid within the control chamber.

It will be appreciated that the metering means may be provided within the stroking chamber for metering of the substantially incompressible fluid or, alternatively, may be provided in the primary stroking chamber to meter the well fluid disposed therein. In the latter case, it may be desirable to also provide the device of the present invention with means for filtering the well fluid prior to communication of the well fluid with the metering means so that contaminants and other particulate matter within the well fluid do not become clogged within the orifice or other similar metering means.

When drilling, completing or working over a subterranean well, an extraneous fluid, such as a weighted or other drilling fluid or completion or workover fluid is introduced into the well through a tubular conduit for, in the case of a drilling operation, circulating drilled cuttings out of the well and for cooling and lubrication of the drill bit and other ancillary purposes. Additionally, subterranean wells often times will contain natural fluids therein, such as water, mixtures of oil or gas from substraights traversed by the bore hole, and other similar naturally occurring fluids. Accordingly, when used herein and particularly in the claims appended hereto, the phrase "well fluids" contemplates drilling fluids, workover and completion fluids, and those naturally occurring well fluids, as described above. Accordingly, the device of the present invention is responsive to the hydrostatic pressure of such well fluids within the well in the wellbore.

A housing is provided with a piston assembly within the housing and including a stroking rod and a piston head having a differential pressure area for application of such hydrostatic pressure of the well fluids upon the piston head. The valving means provided in the invention selectively control the application of the hydrostatic pressure of the well fluids upon the piston head, while metering means are provided for controlling the rate of flow of such well fluids within the housing. Means are provided for operatively securing the device to an auxiliary tool whereby the auxiliary tool may be manipulated in response to stroking of the rod.

DESCRIPTION OF THE PREFERRED EMBODIMENTS

Now, with first reference to FIGS. 1A–1D, there is shown the device 1 of the present invention. The view of the device 1 shown in FIGS. 1A–1D is prior to introduction of the device into the subterranean well and before hydraulic or other control fluid is placed therein as well as before an incompressible stroking fluid is placed within a stroking chamber.

The device 1 may be run into the well by any one of a number of convenient and known ways. Typically, the device is secured to an electric line (not shown) at one end and is also secured within the uppermost end of a pressure setting assembly, in known fashion, such as the Model "E-4" Wireline Pressure Setting Assembly of Baker International Corporation.

The device 1 includes an elongated housing 100 which includes at its uppermost end a control housing top 131 which is secured by threads 134 to a control housing member 101. A series of circumferentially extending elastomeric O-ring seal elements 132 and 133 are provided within companion grooveways on the control housing top 131 to prevent fluid communication between the member 131 and the member 101. Likewise, the control housing member 101 is secured at its lowermost end at threads 115 to a passageway housing member 113. O-ring seal elements 114A and 114B are provided immediate the threads 115 to prevent fluid communication between the passageway housing member 113 and the control housing member 101.

The housing 100 continues lowerly of the control housing member 101 by means of an elongated cylindrical primary piston housing member 102 secured to the passageway housing 113 at threads 112, with O-ring seal elements 111A and 111B disposed between the members 102 and 113. The primary piston housing member 102 defines an upwardly facing circumferential shoulder abutment 102A immediate its lowermost end for interface with the lower face 118B of a first piston member 118, as described, below. Internal threads 109 on the primary piston housing member 102 secure the member 102 to a secondary piston member housing 103. O-ring seal elements 110A and 110B are provided between the top end of the secondary piston member housing 103 and the lowermost end of the primary piston housing member 102 to prevent fluid communication therebetween.

The secondary piston member housing 103 houses a solid stroking rod member 120 which is secured at its uppermost end by means of threads 119 to the first piston 118. The first piston 118 may be stroked within the primary chamber 117 as described below. The first piston 118 includes an upwardly facing first piston head 118A which is always in communication with a primary stroking chamber 117 provided interiorly through the primary piston housing member 102. A first differential pressure area 119 is defined across the first piston head 118A at the dynamic seals 120A and 120B provided around the exterior of the first piston head 118 for sealing contacting engagements across smooth inner wall 102A of the primary piston housing member 102.

As better illustrated in FIGS. 2A–2D, the secondary piston member housing 103 provides a stroking chamber 1120 therein for receipt of a substantially incompressible fluid 130, such as tap water, which fills the stroking chamber 1120 from the bottom thereof to the approximate top defined by a fluid normal fill line 124B. The top of the column of the substantially incompressible fluid 130 within the stroking chamber 1120 is defined by the normal fill line 124B and defines the lowermost end of a thermal expansion area 124A. The top of the thermal expansion area 124A constitutes the effective inner face or second piston head 122A.

The second piston assembly 122 is secured at threads 121 to the lowermost end of a stroking rod 120, and has defined thereacross a second differential pressure area 123C immediate primary and secondary elastomeric seal members 123A and 123B housed within companion grooveways around the exterior of the second piston assembly 122. The second piston assembly housing 122 provides a control fluid chamber 124 therein which extends to the lowermost end of the secondary piston member housing 103.

Thus, the outer housing 100 extends lowerly of the primary piston housing member 102 by means of the secondary piston member housing 103 and is terminated at the lowermost end by means of a cross-over housing member 104 secured to the secondary piston member housing 103 by threads 105. Seals 108A and 108B are provided to prevent fluid communication between the secondary piston member housing 103 and cross-over housing member 104.

The cross-over housing member 104 defines the lowermost end of the device 1 and has threads 107 for securing the device 1 into the hollow interior of a wireline pressure setting assembly or the like (not shown), with seals 106A and 106B being provided around the lowermost exterior end thereof to provide sealing integrity between the cross-over housing member 104 and the interior of a housing or other member of the pressure setting assembly to which is secured the lowermost of the device 1.

Figure 2A:
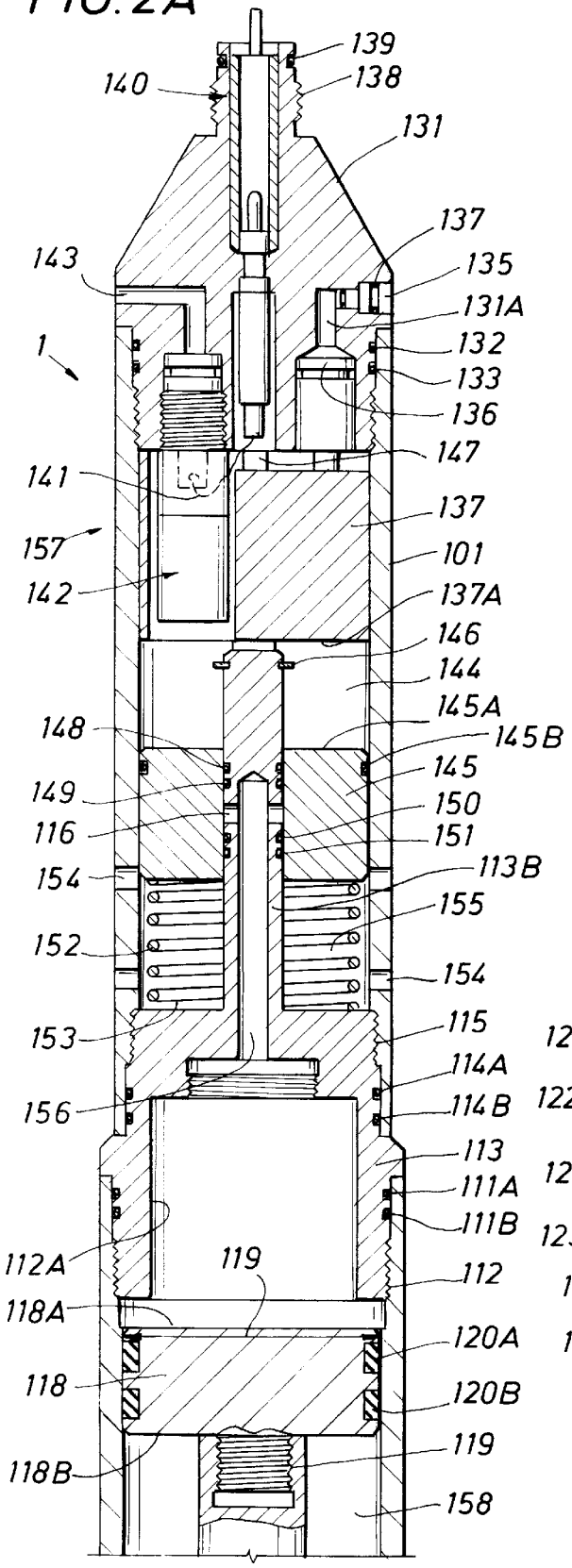
FIGS. 2A–2B together constitute a view similar to that of FIGS. 1A–1D showing the device of the present invention subsequent to introduction of control fluid into the control fluid chamber of the valving means, as well as subsequent to introduction of an incompressible fluid in the stroking chamber, with the stroking rod carrying the first and second piston heads being positioned to provide maximum area within the stroking chamber.
Figure 2B:
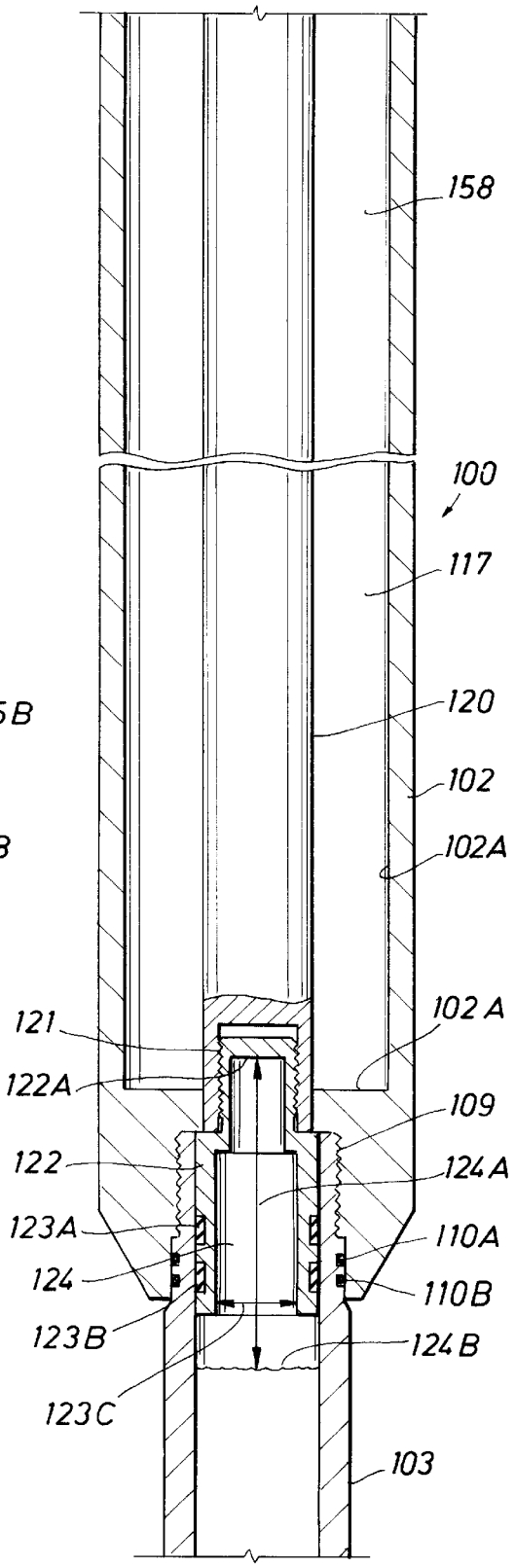
Figure 2C:
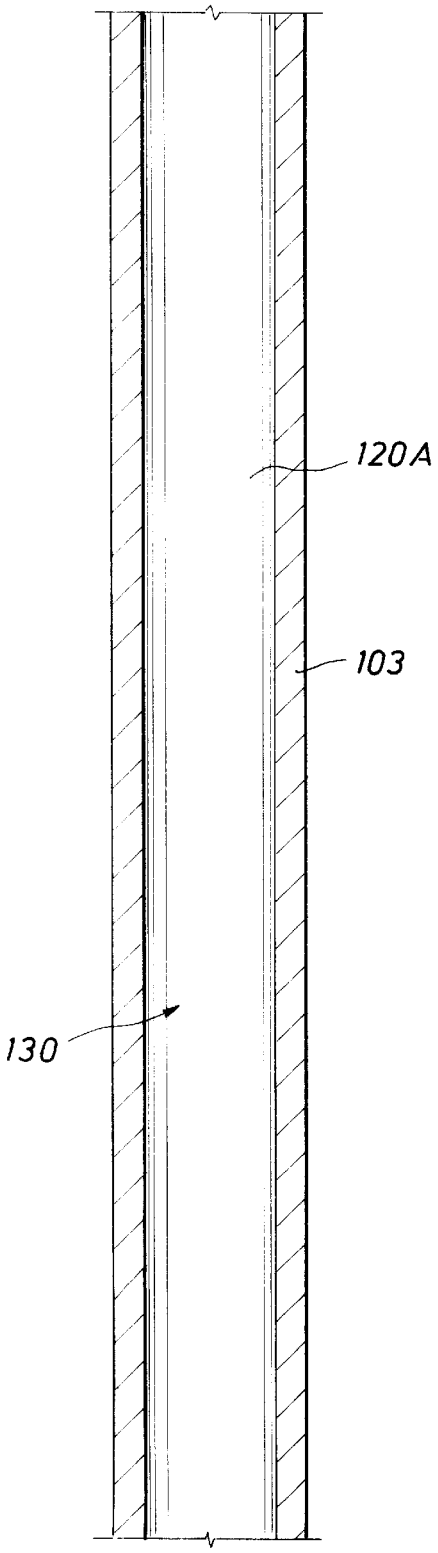
Figure 2D:
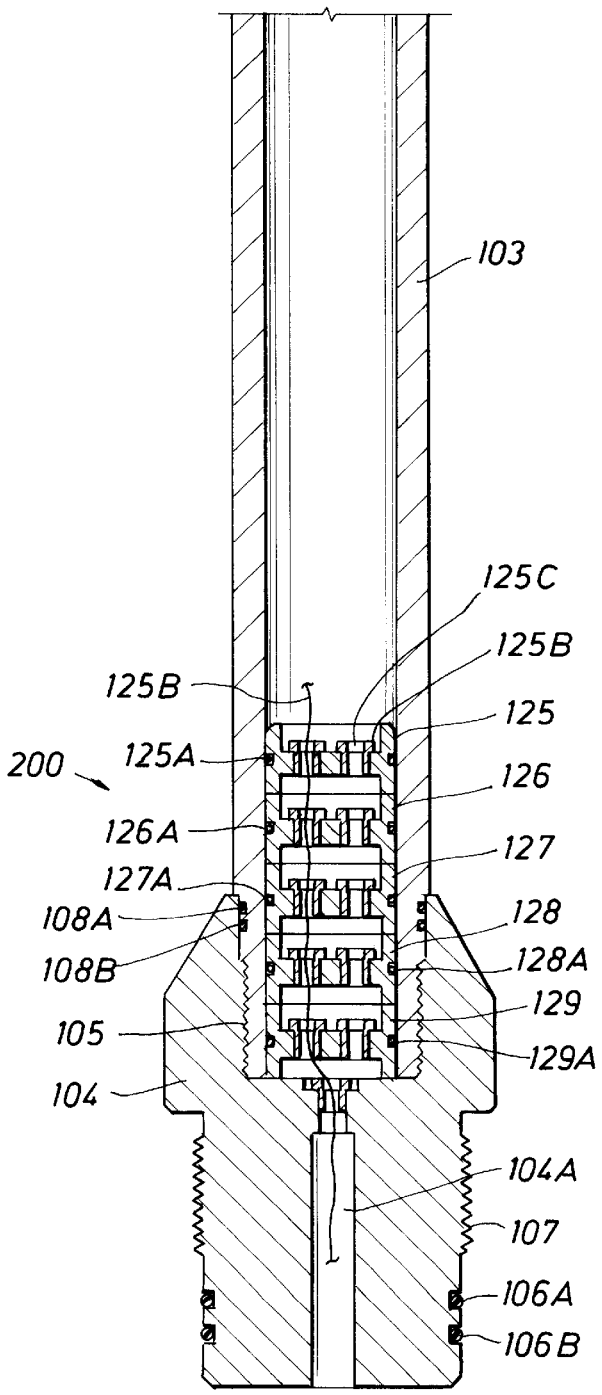
Figure 3A:
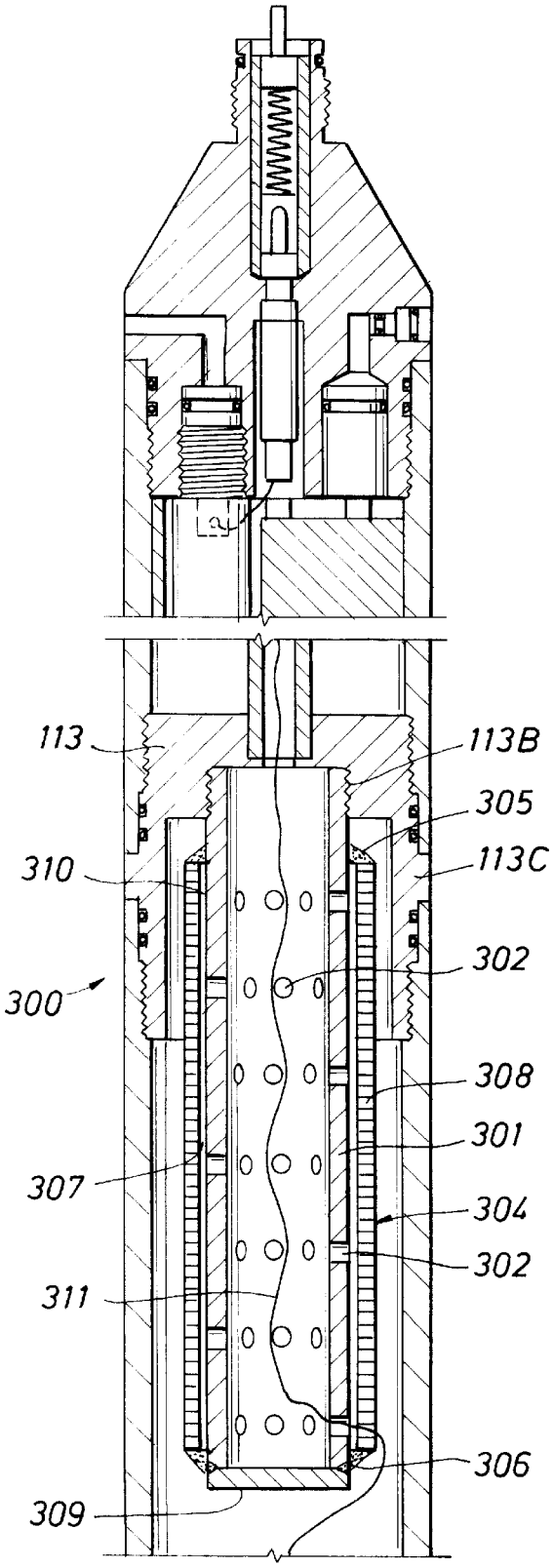
FIGS. 3A–3C show an alternative embodiment of the present invention with the metering means being positioned within the primary chamber for the metering of filtered well fluid as opposed to the incompressible fluid utilized in the embodiment of the invention shown in FIGS. 1A–1D and 2A–2D.
Figure 3B:
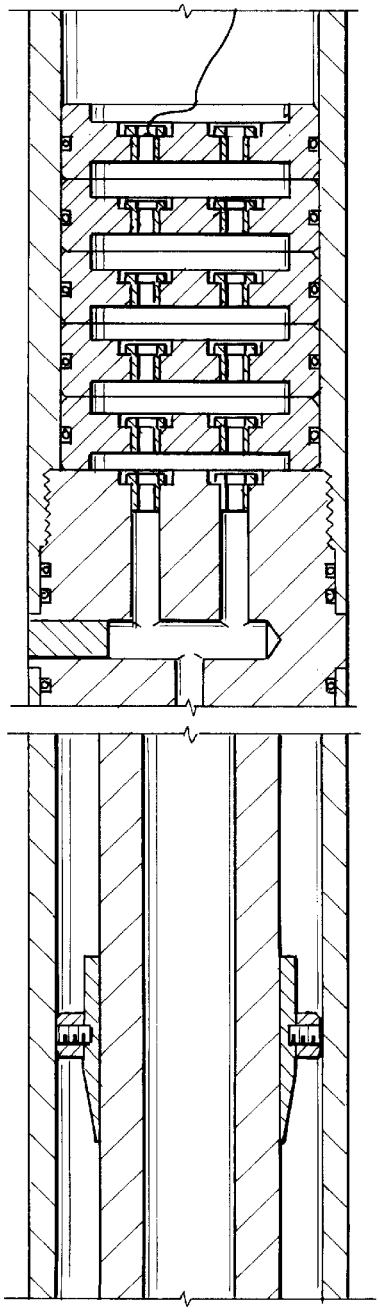
Figure 3C:
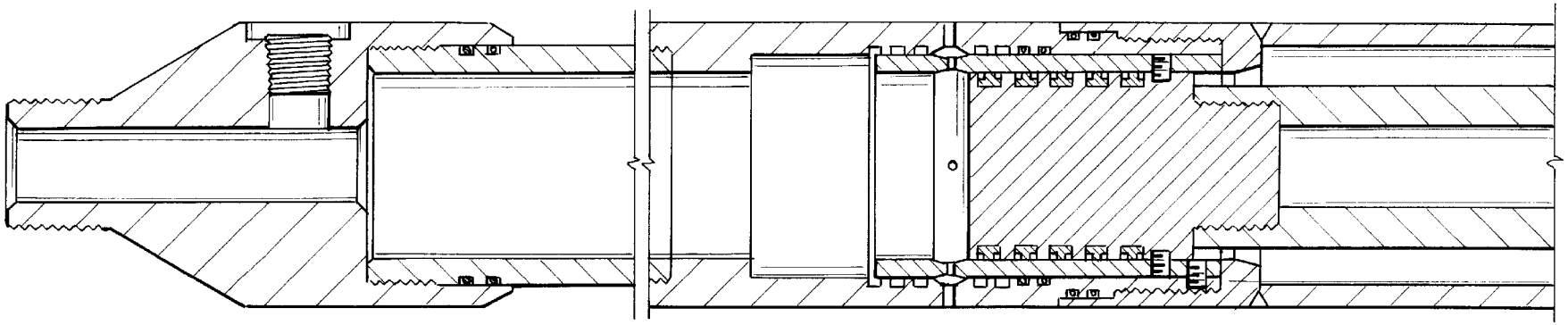

The device 1 of the present invention also incorporates the use of metering means 200 which may be placed within the stroking chamber 1120 as shown in FIGS. 1A–1D and 2A–2D. Alternatively, as shown in FIGS. 3A–3C, the metering means may be placed within the primary chamber 117. The metering means 200, as shown, consists of a series of longitudinally stacked floating plates 125, 126, 127, 128, and 129, with an elastomeric seal 125A, 126A, 127A, 128A and 129A being disposed around the approximate exterior center of each plate, respectively, to avoid fluid leakage between the exterior of the respective plates and the interior of the secondary piston member housing 103 and to provide smooth movements of the plates across the smooth internal wall of the stroking chamber 1120. Each plate consists of a small orifice housing 125B which may be threadedly or otherwise permanently secured through a profile or bore in the plate and has a metering orifice 125C disposed therethrough. A similar orifice housing 125D is disposed within the cross-over housing member 104. As pressure is exerted within the stroking chamber 1120, described below, the substantially incompressible fluid 130 within the chamber 1120 will be slowly metered through the orifice openings 125C within the housings 125B of each of the respective plates, one from another, as indicated by the arrow through the respective orifice openings 125C, thence within a companion passageway 104A defined within the cross-over housing member 104 for application within the setting assembly and upon the auxiliary tool, or the like, for activation.

The valving means 157 is disposed at the uppermost end of the device 1 and is included within the control top housing 131 and the control housing member 101 with the terminal lowermost end defined by the passageway housing 113. The valving means 157 includes first, second and third chamber members. The first chamber member is defined as the control fluid chamber 144 within the control housing member 101. The second chamber member 155 is also defined within the control housing member 101 and is separated from the control fluid chamber 144 by means of a valve head 145 which is secured within the control housing member 101 and around a passageway extension 113B which is an elongated upward extension of the passageway housing 113. The valve head 145 has an upward face 145A which defines the lowermost end of the control fluid chamber 144 with a grooveway for a circumferentially extending elastomeric O-ring seal element 145B housed therein to prevent fluid communication between the valve head 145 and the control housing member 101 exterior thereof.

As shown in FIG. 1A, the valve head 145 is urged upwardly around the passageway extension 113B by the compressive bias of a spring biasing means 152 housed within the control housing member 101, the spring 152 having its lowermost end abutting an upwardly facing surface 153 on the passageway housing 113 and the upper end of the spring 152 biased against the lower face 145C of the valve head 145. The valve head 145 upper movement is terminated when the upper face 145A contacts a shouldering retainer ring 146 disposed outwardly and carried within the uppermost end of the passageway extension 113B.

In the embodiment of the invention shown in FIGS. 1A–1D and 2A–2D, the second chamber member 155 is always in fluid communication with well pressure and fluid by means of a passageway or port 154 which is bored through the control housing member 101. Additionally, a "V"-notch 1154 is provided slightly upwardly of the port 154 through the control housing member 101 so that the position of the valve head 145 may be positively visually observed when the valve head 145 is in position to isolate the second chamber member 155 from the third chamber member 156 defined within the passageway extension 113B, the passageway housing 113 extending into the primary stroking chamber 117. Thus, in effect, the third chamber member of the valving means 157 consists of the third chamber member 156 as well as the interior of the housing main body 113A and the primary stroking chamber 117.

The valving means 157 also includes within the control fluid chamber 144 a volume absorber 137, which is a solid component and which is threadedly secured to the interior of the control housing top 131 at threads 147. The volume absorber 137 may be of a selected size depending upon the volume of control fluid necessary to be injected in the control fluid chamber 144. The volume absorber 137 has upper and lower faces, 137B and 137A, respectively. The size of the volume absorber thus controls the total area in the chamber 144 so that the volume of the chamber 144 may be varied, depending on the depth of operation of the device in the well, as well as the bias required through the spring 152. Threading of the absorber within the chamber provides a convenient means for placement of various sized absorbers, as required.

The valving means 157 also includes a check valve 136 in the control housing top 131 to permit flow of hydraulic control fluid into the control fluid chamber 144, and which prevents discharge of such fluid therethrough. The control fluid is introduced through the control housing top 131 through a passageway 131A bored therein and which is sealed after introduction of the hydraulic fluid by means of a threaded plug member 135 having seal member 137 disposed thereon. A one-way solenoid valve assembly 142 is also housed within the control housing top 131 and is actuated by means of an electric cable 141 extending to an electric line connector 140 also secured within the uppermost end of the control housing top 131. The electric line connector 140 is, in turn, secured to an electric line or cable of conventional nature (not shown) which extends to the top of the well and on which the device 1 may be carried and actuated in the well. Seals 139 are carried around the uppermost end of the control housing top 131 to seal against the inner wall of an electric line shield connector (not shown) which may be threadedly secured to the device i at threads 138.

The one-way solenoid valve assembly 142 may be any one of a number of commercially available solenoid valve assemblies 142 typically utilized in subterranean wells and similar operations. A discharge passage 143 is bored within the control housing top 131 and offset 180 degrees from the passageway 131A for introduction of the hydraulic control fluid through the Device 1.

Finally, an atmospheric chamber 158 is defined in the primary piston housing member 102.

In operation of the valving means 157, hydraulic fluid is introduced into the device through the passageway 131A to compress the spring 152 and move the valve head 145 across a flow passageway 116 communicating between the second chamber member 155 and the third chamber member 156 and defined within the passageway extension 113B. Upper seal members 148 and 149 and lower seal members 150 and 151 bridge the flow passageway 116 to prevent fluid communication between the valve head 145 and the passageway housing 113 when the control valve head 145 is straddled across the flow passageway 116 to prevent communication of fluid between the second and third chamber members 155, 156. Correct positioning of the valve head 145 in the blocking position, as shown in FIG. 2A, may be visually confirmed by observation of the valve head 145 across the V-notch 154 in the control housing member 101.

Now referring to the FIG. 3-series of views, there is shown an alternative embodiment of the present invention, in which the metering means 200 is positioned within the primary chamber 117 of the primary piston housing member 102, as opposed to being positioned within the stroking chamber 120A. In such instance, it may be desirable to provide the filtering means 300, because the fluid which enters the primary chamber 117 will be the well fluids which can be expected to contain particulates, contaminants and similar foreign materials which may adversely interfere with the continuous flow of such fluid through the respective orifices, 125C, within the orifice housing 125B, etc. Accordingly, as shown, the filtering means 300 is secured at threads 113B to the passageway housing 113, and an O-ring seal element 113C is disposed immediate the threads 113B to prevent fluid communication between the passageway housing 113 and the elongated cylindrical ported housing 301 secured by the threads 113B to the passageway housing 113.

The ported housing 301 has a series of circumferencially extending vertically disposed ports 302 traversing therethrough communicating with openings 308 in a slotted or spiralling wire screen section 304 having an inner annular area 307 between the screen section 304 and the elongated ported housing 301. The screen section 304 is secured at the upper most end to the ported housing 301 by means of a weld 305, or other conventional means, and is secured to the lower most end thereof by similar weld 306. The end 309 of the ported housing 301 is closed.

Accordingly, as the well fluids in the subterranean well flow into the device 1 through the port 154 in the control housing member 101 (and the "V"-notch 1154-1) and into the second chamber 155, thence through the flow passageway 116, the well fluids will continue downwardly through the filtering means ported housing 301, thence through each of the respective ports 302 and across the openings 308 in the screen section 304 to an annular area 310 defined between the exterior of the screen section 304 and the interior of the primary piston housing 102, thence downwardly through each of the respective orifice openings 125C in the orifice housing 125B, etc. This flow area is shown by the direction of the arrow and accompanying line 311.

By providing the filtering means 300, the particulate and contaminant matter in the well fluid will be deposited interiorally of the ported housing 301 and upon the interior of the closed end 309 as flow turbulence is distorted and the direction of flow altered by means of the flow changing course and directed through the ports 302 and through the screen section 304. Additionally, the slight annular area 307 may enhance filtering of such fluids by also providing a slight additional discharge area for contaminants. Of course, the screen section 304 may be placed interior of the ported housing 301 and welded to the inside of such housing 301, or otherwise permanently secured.

The invention contemplates a device which may be designed to "push," "pull" or otherwise apply a manipulating force to an auxiliary tool, which may be a setting device which itself, in turn, is operatively secured to a well packer, hanger, or other tool, or the device of the present invention may be directly operatively secured to such packer or other device.

An atmospheric chamber is always provided immediate a piston member which is associated with a force balanced control or stroking rod with fluid metering means being operatively associated with energy applied to the piston. Valving means are biased in a direction to isolate well fluids, the hydrostatic pressure of which serves to initiate the actuation of the device. The valving means is balanced to closed, initial position by means of fluid, such as hydraulic control fluid, being applied in a chamber against one end of the valving means, with the valving means being biased toward a closed direction. The valving means are activated such as by electric solenoid-actuated means, or by any other means which are capable of sending a mechanical, hydraulic or electric or equivalent signal to shift the valving means from closed to opened position to permit the well fluid to initiate actuation of the device, either in a "push," or "pull" or other manipulating activation.

In the embodiment shown in FIGS. 1A–1D and 2A–2D, the invention contemplates intensification of the pressure applied to the control fluid chamber 124. The pressure of the well fluids at the depth of operation of the tool (which is known and pre-calculable) may be multiplied times the difference in the area between the first differential pressure area 119 minus the area of the second differential pressure area 123C, divided by the area of the first differential pressure area 119 to define the force that is applied upon the control fluid chamber 124. Typically, an intensification of well pressure transmitted to the control fluid chamber 124 can be enhanced by factor of 3, or more. Accordingly, if the bottom hole well pressure is approximately 4,000 p.s.i., the result of pressure generated within the control fluid chamber 124 will be three times greater, or 12,000 p.s.i., which is substantially higher than the pressure which is typically generated in a commercially available setting mechanism to sever a tension bolt, or the like, to initiate the chain of events required to activate an auxiliary tool, such as an inflatable packer, or the like.

OPERATION

Now referring to FIGS. 1A–1D, prior to running the device 1 into the well, the plug 135 is removed and commercially available hydraulic or other fluid is introduced under pressure through the passageway 131A and into and through the one way check valve 136 to fill the control fluid chamber 144. As the chamber 144 is filled, the valve head 145 will compress the spring 152 and lower face 145C will straddle the V-notch 1154-1, where the position of the valve head 145 may be visually observed. Upon such observance, the operator terminates filling the chamber 144 and the plug 135 is placed in the passageway 131A.

Likewise, before the secondary piston member housing 103 is secured at threads 109 to the primary piston housing member 102, the stroking chamber 1120 is filled to the fluid normal fill line 124B with a substantially incompressible fluid, such as tap water. Now, with the stroking rod 120 previously placed within the primary piston housing member 102 and shifted to its upper most position, as shown in FIG. 2A–2D, the secondary piston member housing 103 is threadly secured at 109 to the housing 100.

Since the stroking rod 120 is not shear-pinned or otherwise selectively secured to the primary piston housing member 102, it may move freely, somewhat, within the primary piston housing member 102 and the secondary piston member housing 103. It will be appreciated that the primary chamber 117 automatically becomes an atmospheric chamber, as identified by numeral 158 as the device 1 is prepared for operation in the well.

Prior to introduction of the device 1 into the subterranean well, the setting tool, or other auxiliary tool is secured by means of threads 107 within an interior housing (not shown) which serves as a continuation of the passageway 104A and a chamber for application of the pressure within the substantially incompressible fluid 130 as it is orifice or otherwise metered through the metering means 200.

Likewise, an electric or slickline is secured to the top of the device (not shown) at the electric line connector 140, in conventional fashion. Now, the device 1 may be introduced into the subterranean well along with the auxiliary tool.

When it is desire to actuate the auxiliary tool, an activating signal, such as a positive or negative electric pulse is sent through the electric line connector 140 to the one way solenoid valve assembly 142 and hydraulic control fluid within the control fluid chamber 144 is discharged through the valve assembly 142 and out of the control housing cup 131 through the discharge passage 143. As the control fluid in chamber 144 is discharged, the biased compressive force transmitted through the compressed spring 152 will act upon the lower face 145C of the valve head 145 to move same upwardly, until further upward movement is prevented by contact of the upper face 145A of the valve head 145 with the retainer ring 146. In such position, the valve head 145 has opened and permitted fluid communication between the flow passageway 116 and the second chamber member 155 and the third chamber member 156. Hydrostatic well pressure and fluid flow now act upon the first differential pressure area 119 of the first piston member 118, driving the stroking rod 120 downwardly within the device through the primary piston housing member 102 and the secondary piston member 103. However, the substantially incompressible fluid 130 normal fluid flow is interfered with as a result of the requirement of such fluid to pass through the orifice openings 125C, etc. and the metering means 200 housed within the secondary piston member 103, thus extending, or metering, the application of such fluid through the device and the setting or other auxiliary tool actuating mechanism, to prolong and extend the setting cycle. Moreover, when an embodiment is utilized in which plural pistons are incorporated into the design of the device, the pressure applied within control fluid chamber 124 has been intensified as a result of the difference between the differential pressure areas across piston areas 119 and 123C.

The metered stroking of the stroking rod 120 is terminated when the lower face 118B of the first piston 118 is shouldered against the upwardly facing shoulder 102A of the primary piston housing member 102. Accordingly, the auxiliary tool should now be completely actuated or manipulated.

The operation of the embodiment shown in FIGS. 3A, etc., is substantially the same as described, above, the only substantial difference being the placement of the metering means 200 within the primary piston housing member 102, and the provision of the filtering means 300.

While not necessary, as described above, it is contemplated that the device 1 of the present invention may be utilized in conjunction with a setting tool containing a conventional power charge, as described above, to further enhance the driving power applied to the substantially incompressible fluid in the control fluid chamber 124 (the stroking chamber 120A and the control fluid chamber 124 being identical). In particular, if desired, the setting tool activated by a conventional power charge may be utilized to boost such power and application of the stroking rod 120 at the end of the stroke to provide enhancement of stroking energy at the substantial end of the setting or manipulating cycle for the auxiliary tool.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A pressure balanced, slow actuating device for manipulation of an auxiliary tool within a subterranean well, said device being responsive to the hydrostatic pressure of well fluids within said well, said device comprising:

(1) a housing;

(2) a piston assembly within said housing and including a stroking rod and a piston head having a differential pressure area thereacross for application of the hydrostatic pressure of the well fluids to said piston head;

(3) valving means in fluid communication with said well fluids for selectively controlling the application of the hydrostatic pressure of the well fluids upon the piston head;

(4) metering means for controlling the rate of flow of the well fluids within said housing; and (5) means for operatively securing said device to said auxiliary tool whereby said auxiliary tool may be manipulated in response to stroking of said rod.

2. A pressure balanced, slow actuating device for manipulation of an auxiliary tool within a subterranean well, said device being responsive to the hydrostatic pressure of well fluids within said well, said device comprising:

(1) a housing;

(2) a piston assembly within said housing and including a stroking rod and a piston head having a differential pressure area thereacross, said stroking rod being manipulatable in response to application of pressure across said piston head upon introduction within said housing of the well fluids;

(3) valving means for selectively permitting the flow of the well fluids within said housing;

(4) metering means, for controlling the rate of flow of a fluid body within said housing upon flow of the well fluids within said housing; and (5) means for operatively securing said device to said auxiliary tool whereby said auxiliary tool may be manipulated in response to stroking of said rod.

3. A pressure balanced, slow actuating fluid device for manipulation of an auxiliary tool within a subterranean well, comprising:

(1) a housing;

(2) a primary piston assembly within said housing and including a first piston head having a first differential pressure area thereacross for application of hydrostatic pressure within said well to said primary piston assembly;

(3) valving means for selectively controlling the application of the hydrostatic well pressure upon the primary piston assembly;

(4) a chamber within said housing for receipt of a substantially incompressible flowable actuating fluid and including an area for accommodation of thermal expansion of said actuating fluid;

(5) metering means for controlling the rate of flow of said actuating fluid through said chamber and within the auxiliary tool;

(6) a secondary piston head disposed within said chamber and including a second differential pressure area thereacross and responsive to fluid pressure within said chamber and said auxiliary tool, the differential pressure area of said first piston head being substantially greater than the differential pressure area of said secondary piston head; and (7) an elongated stroking rod operatively disposed between the first and secondary piston heads and within said housing.

4. The device of claim 1, claim 2 or claim 3 wherein said valving means comprises:

(1) first, second and third chamber members, said first chamber member receiving a body of injected control fluid therein;

(2) a flow passageway extending between said second and third chamber members;

(3) means for communication of well fluid into the third chamber member;

(4) a valve head member between said first, second and third chamber members and sealing selectively positionable across said passageway to prevent fluid flow from said second chamber member into said third chamber member;

(5) means for discharging the control fluid out of the first chamber member; and (6) means for biasing the valve head member in one direction to open the flow passageway between the second and third chamber members upon the discharge of the control fluid from within the first chamber member.

5. The device of claim 4 wherein the means for discharging control fluid comprises a one-way solenoid-actuated valve means.

6. The device of claim 4 wherein the third chamber member is in continuous communication with a piston head.

7. The device of claim 1, claim 2 or claim 3 wherein said metering means comprises at least one floating plate disposed within said housing each floating plate including at least one orifice member defined therethrough.

8. The device of claim 1, claim 2 or claim 3 wherein said metering means comprises a series of stacked floating plates, each plate having a plurality of orifice members disposed therethrough.

9. A pressure balanced, slow actuating device for manipulation of an auxiliary tool within a subterranean well, comprising:

(1) a housing;

(2) a primary piston assembly within said housing and including a first piston head having a first differential pressure area thereacross for application of hydrostatic pressure of fluid within said well to said piston assembly;

(3) metering means for controlling the rate of flow of fluid within said well through said housing and upon said first piston head;

(4) valving means for selectively controlling the application of the hydrostatic well pressure on the primary piston assembly;

(5) a chamber within said housing for receipt of an incompressible flowable actuating fluid and including an area for accommodation of thermal expansion of said actuating fluid;

(6) a secondary piston head disposed within said chamber and including a second differential pressure area thereacross and responsive to fluid pressure within said chamber and said auxiliary tool, the differential pressure area of said first piston head being substantially greater than the differential pressure area of said secondary piston head; and (7) an elongated stroking rod operatively disposed between the first and secondary piston heads and within said housing.

10. The device of claims 1, 2, 3 or 9, further comprising means for filtering particulate matter from the well fluid and within the housing.

11. The method of setting an inflatable packer within a subterranean well comprising the steps of:

(a) introducing into the well on a conduit said packer and a pressure balanced slow-activating setting device, said setting device comprising:

(1) a housing;

(2) a piston assembly within said housing and including a stroking rod and a piston head having a differential pressure thereacross for application of the hydrostatic pressure of the well fluids to said piston head;

(3) valving means in fluid communication with said well fluids for selectively controlling the application of the hydrostatic pressure of the well fluids upon the piston head;

(4) metering means for controlling the rate of flow of the well fluids within said housing; and (5) means for operatively securing said device to said inflatable packer whereby said inflatable packer may be manipulated in response to stroking of said rod;

(b) positioning said inflatable packer at a predeterminable location within said well; and (c) manipulating said valving means to apply the hydrostatic pressure of the well fluids upon the piston held to stroke said rod and direct fluid to the interior of said inflatable packer to imflate said packer for expansive setting thereof.

12. The method of setting an inflatable packer within a subterranean well comprising the steps of:

(a) introducing into the well on a conduit said packer and a pressure balanced slow-activating setting device, said setting device comprising:

(1) a housing;

(2) a primary piston assembly within said housing and including a first piston head having a first differential pressure area thereacross for application of hydrostatic pressure within said well to said primary piston assembly;

(3) valving means for selectively controlling the application of the hydrostatic well pressure upon the primary piston assembly;

(4) a chamber within said housing for receipt of a substantially incompressible flowable cementitious fluid and including an area for accommodation of thermal expansion of said cementitious fluid;

(5) metering means for controlling the rate of flow of said cementitious fluid through said chamber and within the inflatable packer;

(6) a secondary piston head disposed within said chamber and including a second differential pressure area thereacross and responsive to fluid pressure within said chamber and said auxiliary tool, the differential pressure area of said first piston head being substantially greater than the differential pressure area of said secondary piston head; and (7) an elongated stroking rod operatively disposed between the first and secondary piston heads and within said housing;

(b) manipulating said valving means to initiate flow of said well fluids within said apparatus, whereby said stroking rod displaces said cementitious fluid from within said device and into said inflatable packer to move said packer to expanded and set condition.

* * * * *